US006134856A

United States Patent [19]

Khan et al.

[11] Patent Number: 6,134,856

[45] Date of Patent: Oct. 24, 2000

[54] ROLL ROOFING MEMBRANE

[75] Inventors: Amir G. Khan, Pequannock; Joseph R. Bruns, Sparta., both of N.J.; Richard Darrell Rains, Port Arthur, Tex.; Michael Di Stefano, Sparta, N.J.

[73] Assignee: Building Materials Corporation of America, Wayne, N.J.

[21] Appl. No.: 09/245,529

[22] Filed: Feb. 5, 1999

[51] Int. Cl.[7] ..... E04D 1/10

[52] U.S. Cl. ..... 52/536; 52/409; 52/445; 52/453; 52/519; 52/746.11; 428/152; 428/489; 156/337

[58] Field of Search ..... 52/408, 409, 445, 52/450, 453, 515, 516, 518, 519, 535, 536, 746.11, 539, 540; 428/57, 58, 105, 114, 115, 152, 157, 162, 182, 489; 156/337

[56] References Cited

U.S. PATENT DOCUMENTS 3,937,640 2/1976 Tajima et al. ..... 156/71
3,967,032 6/1976 Plotz et al. ..... 428/300
4,610,902 9/1986 Eastman et al. ..... 428/57
4,825,618 5/1989 Blevins ..... 52/595
5,895,536 4/1999 Starr et al. ..... 156/71

*Primary Examiner*—Carl D. Friedman
*Assistant Examiner*—Yvonne M. Horton
*Attorney, Agent, or Firm*—William J. Davis; Marilyn J. Maue; Walter Katz

[57] ABSTRACT

An improved roll roof membrane for use in commercial applications, i.e., flat and low pitch roof structures, and a method for the preparation thereof. The roof membrane comprises a support sheet, and top and bottom layers comprising APP modified bitumen, the top APP modified bitumen layer having a selvage edge disposed along one side of the membrane and the bottom APP modified bitumen layer having a second selvage edge disposed along the opposite side of the membrane. Each of the selvage edges have a series of embossed ridges and valleys adapted to accept adhesives, the valleys extending substantially through the APP modified bitumen layer to the support sheet. The membrane exhibits excellent peel strength with an adhesive, thereby eliminating the need to use a torch during installation in commercial roofing applications.

5 Claims, 4 Drawing Sheets

ROLL ROOFING MEMBRANE

DESCRIPTION OF THE PRIOR ART

Approximately 60% of the market for commercial roofing membranes currently consists of materials based on atactic polypropylene (APP) modified bitumen The remaining portion consists primarily of materials based on styrene-butadiene-styrene (SBS) modified bitumen. The preference for APP modified bitumen products is based partly on their enhanced performance, longevity and resistance to weathering compared to SBS modified bitumen products.

Heretofore, commercial APP modified bitumen products have required a torch when installed in commercial applications. In practice, the membrane or cap sheet is affixed with an adhesive to a base sheet which in turn is attached, e.g., with screws to an insulative deck which can be fabricated of plywood and/or an isocyanate foam, etc. The so-called salvage edge of one sheet of membrane is overlapped with the salvage edge of the next sheet of membrane. A torch is used to soften the membrane and adhere it to the base sheet. The salvage edges of the overlapping membranes adhere together to achieve a seam sufficient to withstand ambient weather conditions for extended periods of time.

The problems associated with torches are well known. The use of open flames during roof construction can lead to fire risks and accidents. It would be highly desirable to provide commercial roofing membranes which can be satisfactorily bonded together and to the base sheet without the use of a torch.

SUMMARY OF THE INVENTION

We have discovered a commercial roofing APP modified bitumen membrane which does not require the use of a torch to achieve satisfactory performance during installation in commercial roofing applications.

More specifically, in accordance with our invention, there is provided a roof membrane comprising a support sheet having bonded on the top and bottom surfaces thereof layers comprising APP modified bitumen, a first salvage edge disposed in the top APP modified bitumen layer along one side of said membrane, a second salvage edge disposed in the bottom APP modified bitumen layer along the opposite side of said membrane, and wherein each of the salvage edges have a series of embossed ridges and valleys adapted to accept adhesives, the valleys extending substantially through the APP modified bitumen layers to said support sheet.

In another embodiment of our invention, there is provided a method of preparing the above-described roofing membrane comprising providing a support sheet, coating APP modified bitumen in a molten state on both sides of the support sheet, embossing a series of ridges and valleys along one side of the top APP modified bitumen layer and along the opposite side of the bottom APP modified bitumen layer, and solidifying the molten embossed layers by contacting the membrane with water.

It is a particularly advantageous feature of this invention that an APP modified bitumen roofing membrane is provided which can be satisfactorily installed in commercial roofing applications without the use of a torch.

It is another advantageous feature of this invention that a roll roofing membrane is provided exhibiting excellent peel strength with an adhesive and excellent performance, longevity and resistance to weathering.

DESCRIPTION OF PREFERRED EMBODIMENTS

The invention is hereinafter described with reference to certain preferred embodiments, i.e., roofing membranes featuring fiberglass and/or polyester support sheets and APP modified bitumen layers. However, the invention also finds utility with other support sheets coated with layers applied in a molten state.

Suitable support sheets for use herein include sheets fabricated of fiberglass, polyester and fiberglass-reinforced polyester. Such support sheets are known in the art and are also sometimes referred to as "reinforcement" or "scrim". The thickness of the support sheet can range from about 0.1–10, preferably 0.25–7.5 and most preferably 0.5–5 millimeters (mm). Preferred support sheets have a tensile strength greater than about 80 pounds force per inch. A preferred support sheet comprises fiberglass reinforced polyester having a thickness of about 1–2 mm.

The APP modified bitumen layer comprises compounded asphalt, APP, and optionally isotactic polypropylene (IPP), one or more fillers, one or more fire retardants, and one or more additional adjuvants known to be useful in such products.

The atactic polypropylene is well known and commercially available. The APP can be present in the APP modified bitumen layer in an amount from about 5–30%, preferably 10–25% and most preferably 12–22% by weight. Each APP modified bitumen layer can be 0.5–20, preferably 1–10 and most preferably 2–8 mm thick.

Asphalt (bitumen) is well known and commercially available. The APP modified bitumen layer can comprise 25–75%, preferably 30–70% and most preferably 35–65% by weight bitumen. In preferred embodiments, a flexible asphalt, such as grade AC 20 is employed.

In practice the APP and modified bitumen is compounded together optionally with IPP, one or more appropriate fillers and a fire retardant at conventional compounding temperatures of from about 300–450° F.

IPP can be added in amounts up to 20% by weight to enhance stiffness.

Suitable fillers include mica, talc, aluminum and $CaCO_3$. The filler can be present in an amount of about 5–40%, preferably 10–30% and most preferably 15–25% by weight. Fillers generally are added to reduce the final cost of the membrane without compromising the desired properties.

In preferred embodiments, the APP modified bitumen layer comprises up to 40% by weight of a fire retardant. Suitable fire retardants are known in the art and include aluminum trihydride (ATH), borate compounds such as zinc borate, $(CaO)_2(B_2O_3)_3\ 5H_2O$ (Colemanite) and others.

Figure 1:
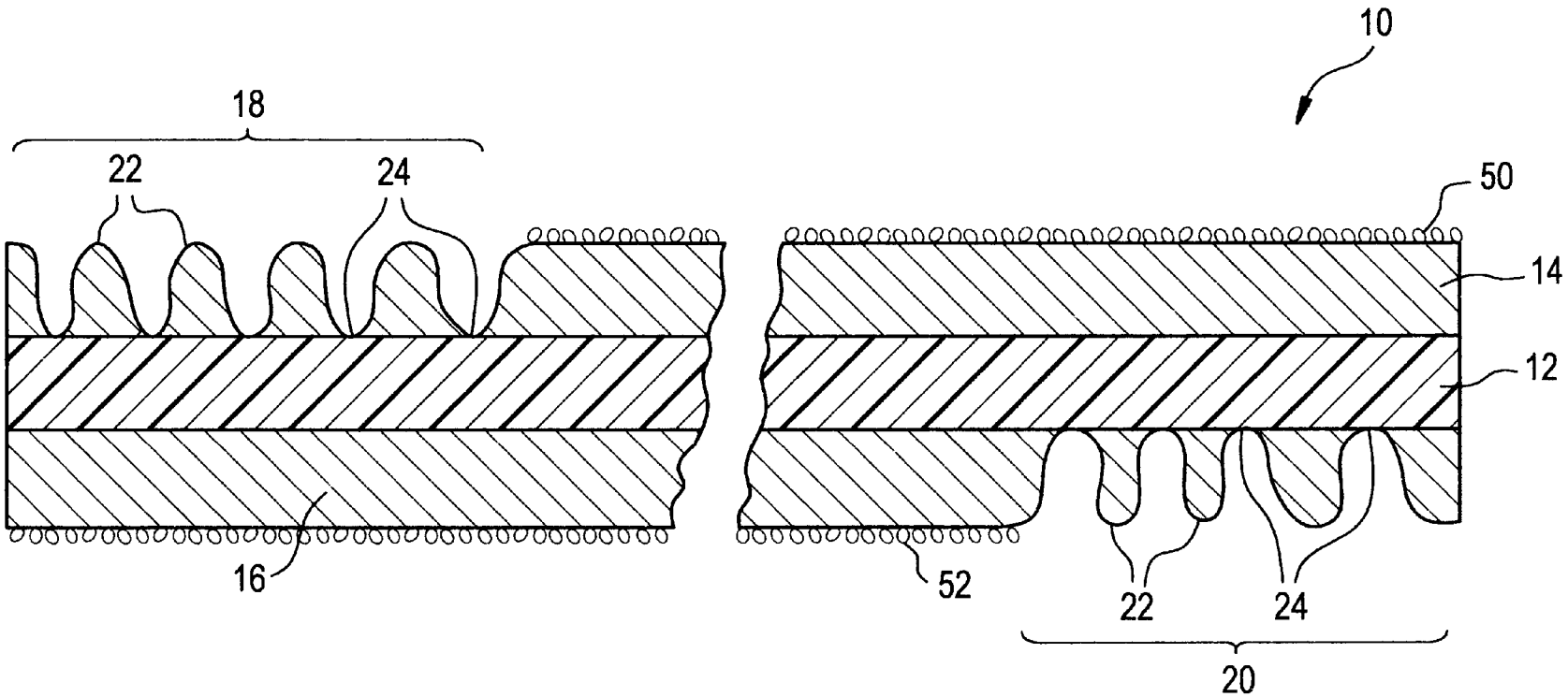
FIG. 1 is a cross sectional view of a roof membrane in accordance with this invention.
Figure 2:
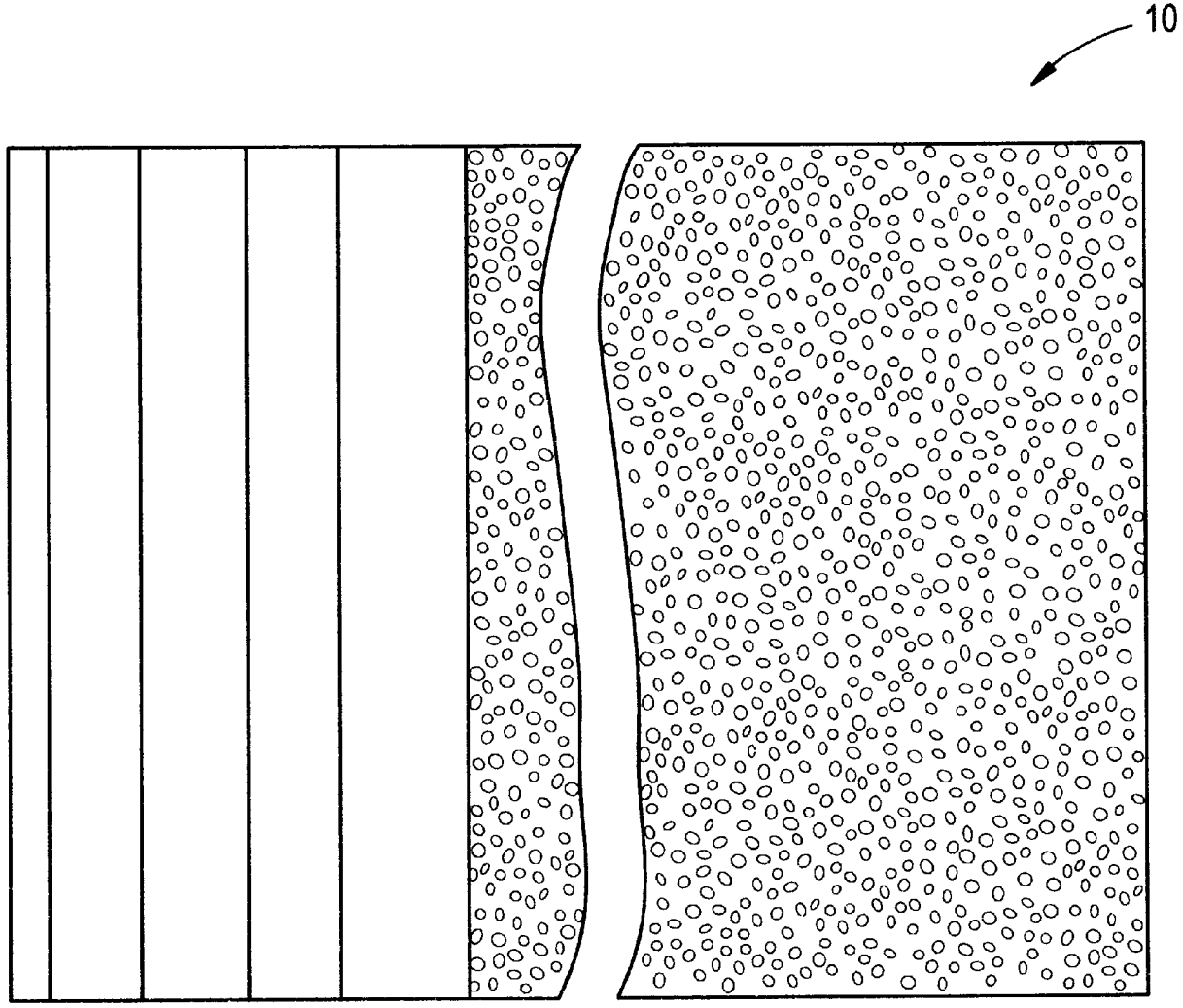
FIG. 2 is a top plan view of the roof membrane depicted in FIG. 1.

FIGS. 1 and 2 illustrate a roof membrane 10 of this invention featuring support sheet 12 having bonded to the top and bottom surfaces thereof top layer 14 and bottom layer 16 each comprising APP modified bitumen. A first selvage edge 18 is disposed along one side of the membrane. A second selvage edge 20 is disposed in the bottom APP modified bitumen layer along the opposite side of the membrane. Selvage edges 18 and 20 have a series of ridges 22 and valleys 24 adapted to accept adhesives. The valleys extend substantially through the APP modified bitumen layers to the reinforcing support sheet.

Figure 3:
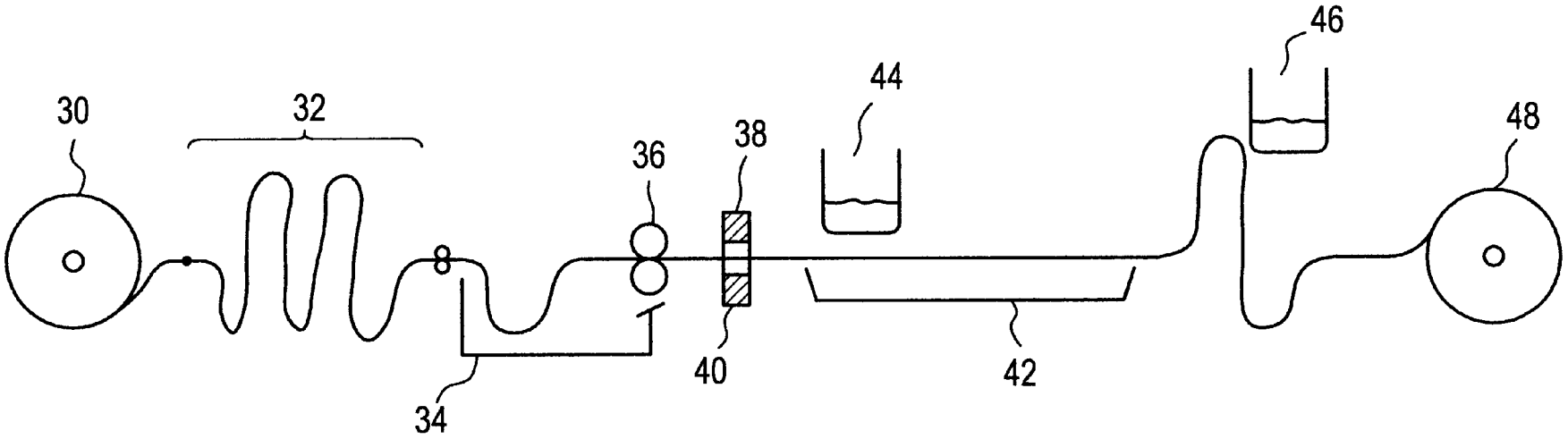
FIG. 3 is a schematic of a preferred method for preparing the roofing membrane of this invention in roll form.
Figure 4:
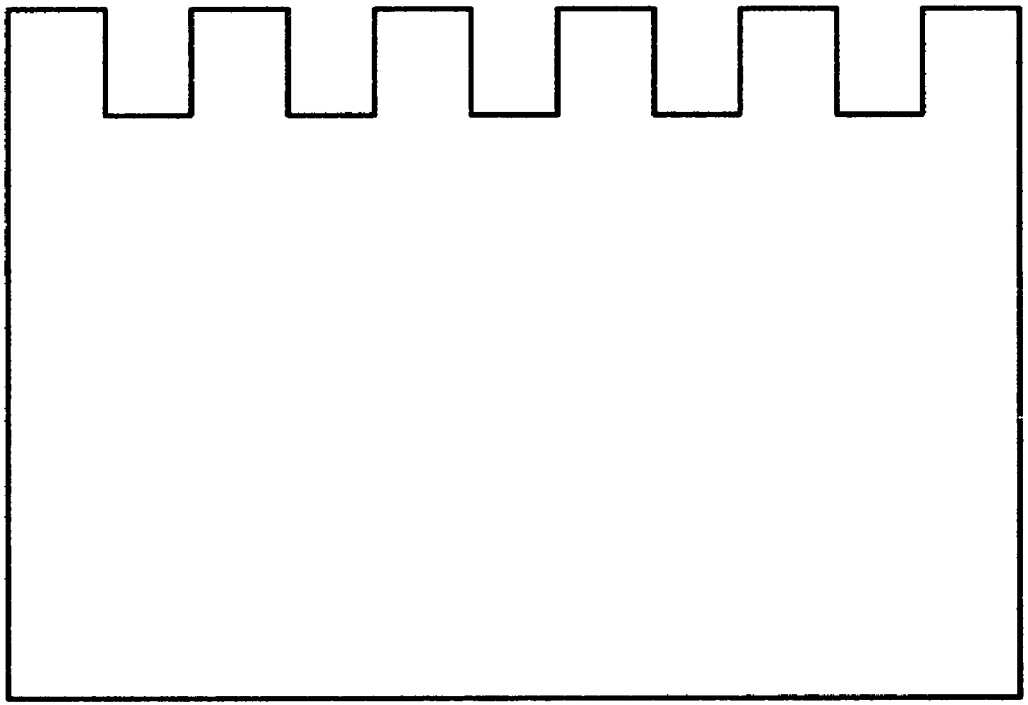
FIG. 4 is a cross sectional view in the machine direction showing details of an embosser.

The membrane can be prepared as follows using conventional equipment heretofore used to manufacture commercial roofing membranes modified with embossers as described below. With reference to FIG. 3, a roll 30 of support sheet is unwound, passes through an accumulator section 32 and is dip coated by immersion in coating vat 34 containing molten compounded APP, asphalt, and optionally IPP, and one or more fillers and fire retardants. Typical compound and vat operating temperatures range from about 300–450° F. The thickness of the coatings can be adjusted using sizing or metering rolls 36. While the coatings are in a molten state, the selvage edges on opposite sides and opposite surfaces of the membrane are contacted with top side embosser 38 and bottom side embosser 40. The embossers can be fabricated of stainless steel and preferably have rectangular grooves as illustrated in further detail in FIG. 4. The top embosser can be aligned at an angle to the machine direction such that molten compound runs off the side of the web for recycle. A particularly advantageous embosser has a width of about 5 inches and contains about 5–7 grooves. Thereafter, the APP modified bitumen layers is cooled and solidified, by floating the membrane web on water bath 42. If granules 50 are employed, they can be added to the top surface of the web through hopper 44 while the APP modified bitumen layer is in at least a partially molten state. If desired, sand 52 or another suitable liquid parting agent such as coconut oil can be added through hopper 46 to the bottom surface of the membrane to reduce the tendency for the membrane to stick during winding and subsequent handling. The membrane can be wound into roll 48 by winding techniques known in the art.

Such membranes typically have a width ranging from about 3–4 feet. Several grades of commercial roofing membranes being sold commercially have a width of about 40 inches. Machine speeds of upwards of several hundred feet per minute are obtainable.

At least some of the valleys extend entirely through the APP modified bitumen layer to the support sheet. We have found that such deep valleys in conjunction with an adhesive provide unexpectedly enhanced bonding performance. Each selvage edge can have a width of about 2–10, preferably 3–9 and most preferably 4–8 inches. Greater overlap tends to provide greater adhesion but at an added material cost per unit area of coverage.

The roofing membranes of this invention are used with an appropriate adhesive. Preferred adhesives include the styrene-ethylene-butadiene-styrene (SEBS) adhesives described in commonly assigned copending U.S. application Ser. No. 09/243,045, filed Feb. 3, 1999 and entitled COLD BOND ADHESIVE, the disclosure of which is hereby incorporated by reference in its entirety. Such adhesives comprise about 55 to 80 weight % solids mixture of (a) a thermoplastic polymer of from about 10 to 100 weight % of SEBS block polymer which may contain up to 90 weight % of an organic elastomer, (b) an aromatic solvent for (a), (c) a non-blown asphalt, (d) an inorganic silicate, (e) a cationic or non-ionic surfactant, (f) cellulose fibers and (g) an inorganic filler.

EXAMPLES

The following formulations were prepared (percentages are by weight):

| Formulation | 1 | 2 |
|---|---|---|
| Asphalt | 52 | 40 |
| IPP | 3 | 3 |
| APP | 20 | 17 |
| $CaCO_3$ | 10 | 0 |
| ATH | 10 | 10 |
| Colemanite | 5 | 30 |

Roof membranes were prepared using a 1 mm fiberglass reinforced polyester support sheet. Each formulation was compounded and deployed in the coating vat. The membranes were prepared in accordance with the process described above. Conventional roofing granules were applied to the top surface of the membrane and sand was applied to the back side.

The resulting membranes demonstrated excellent performance, longevity and resistance to weathering. The membranes were tested with the adhesives described in U.S. patent application Ser. No. 09/243,045 entitled COLD BOND ADHBESIVE referenced above. In these tests, the lap adhesive described in Example 5 was used in the selvage edges and the field adhesive described in Example 1 was used between the membrane and a base sheet. The membranes exhibited excellent peel strength and adhesion, and did not require the use of a torch during installation in commercial roofing applications.

This invention has been described with reference to certain preferred embodiments thereof, but it will be understood that variations and modifications can be effected within the spirit and scope of the invention.

What is claimed is:

1. In a roof membrane comprising a support sheet having bonded on the top and bottom surfaces thereof top and bottom layers comprising APP modified bitumen, a first salvage edge disposed in the top APP modified bitumen layer along one side of said membrane and a second salvage edge disposed in the bottom APP modified bitumen layer along the opposite side of said membrane, the improvement comprising each of said salvage edges having a series of embossed ridges and valleys adapted to accept adhesives, said valleys extending substantially through said APP modified bitumen layers to said support sheet.

2. The membrane of claim 1 wherein said support sheet is selected from fiberglass, polyester and fiberglass reinforced polyester.

3. The membrane of claim 1 wherein each of said salvage edges is approximately 2 to 8 inches in width.

4. The membrane of claim 1 further comprising granules disposed on the top APP modified bitumen layer.

5. A method of making the roof membrane of claim 1 comprising providing a support sheet having top and bottom surfaces, coating APP modified bitumen in a molten state on the top and bottom surfaces of said support sheet, embossing a pattern of ridges and valleys along one side of the top APP modified bitumen layer and along the opposite side of the bottom APP modified bitumen layer, solidifying the molten embossed APP modified bitumen layers by contacting the membrane with water.

* * * * *